United States Patent [19]

Garshelis

[11] 3,939,448

[45] Feb. 17, 1976

[54] MECHANICAL MAGNETS OF MAGNETOSTRICTIVE, REMANENT, CIRCULARLY MAGNETIZED MATERIAL

[76] Inventor: Ivan J. Garshelis, 61 Oleander Way, Clark, N.J. 07066

[22] Filed: July 12, 1974

[21] Appl. No.: 488,841

[52] U.S. Cl. ..... 335/215; 335/285

[51] Int. Cl.[2] ..... H01F 7/20; H01H 55/00

[58] Field of Search ..... 335/215, 302, 306, 284, 335/285, 288; 310/26

[56] References Cited

UNITED STATES PATENTS

| | | | |
|---|---|---|---|
| 518,092 | 4/1894 | Collier | 335/302 |
| 2,287,286 | 6/1942 | Bing et al. | 335/288 |
| 2,920,529 | 1/1960 | Blythe | 335/215 X |
| 3,121,193 | 2/1964 | Engelsted et al. | 335/288 |
| 3,428,867 | 2/1969 | Becker | 335/285 X |

OTHER PUBLICATIONS

"Magnetostriction", The International Nickel Co., pp. 1–7, Feb. 1952.

*Primary Examiner*—G. Harris

*Attorney, Agent, or Firm*—Hubbell, Cohen, & Stiefel

[57] ABSTRACT

Mechanically controllable magnet made of a magnetostrictive, circularly magnetically anisotropic, circularly magnetized rod. There is no apparent magnetism externally. When rod is twisted, circular anisotropy becomes helical and circular magnetization also becomes helical to produce an axial field component and hence externally apparent magnetism. When rod untwists, it restores itself to its apparently non-magnetic condition.

13 Claims, 7 Drawing Figures

FIG. 1.
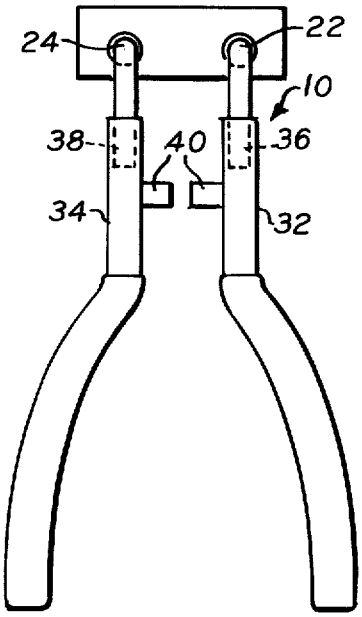
FIG. 4.
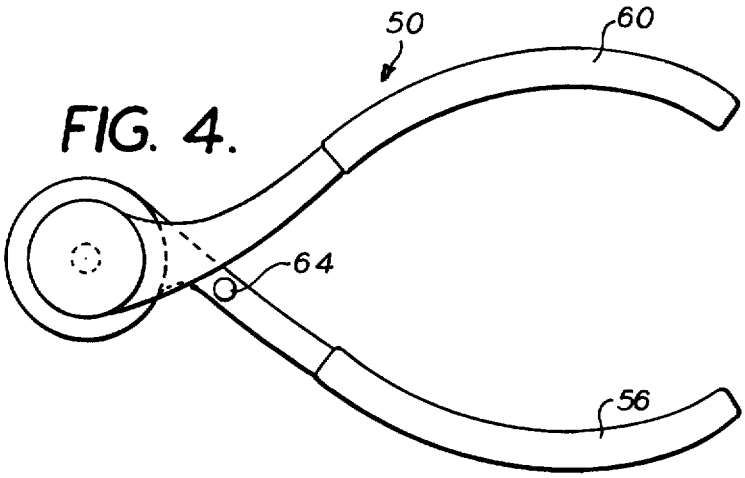
FIG. 5.
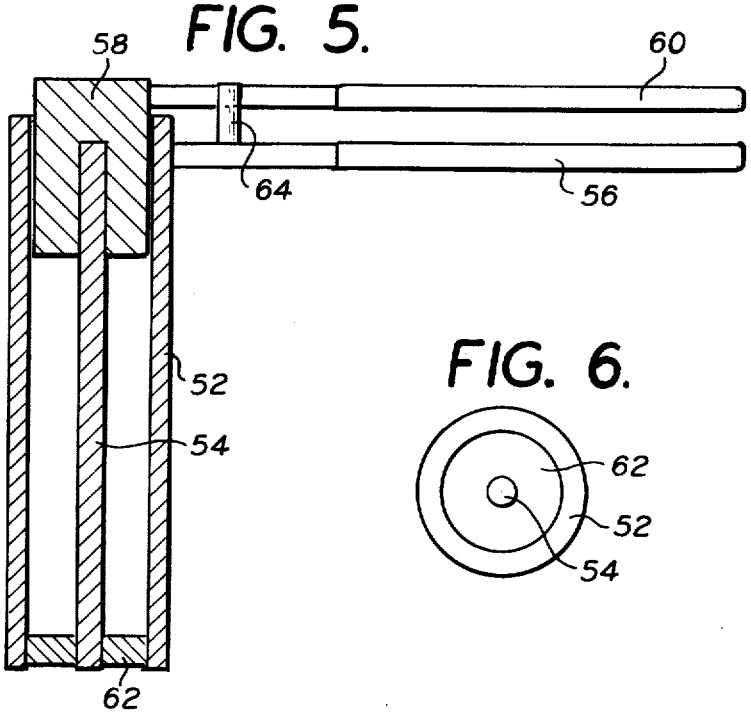
FIG. 2.
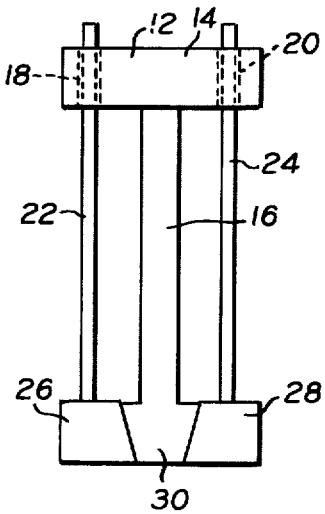
FIG. 6.
FIG. 3.
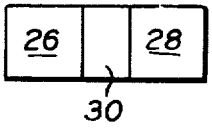
FIG. 7.
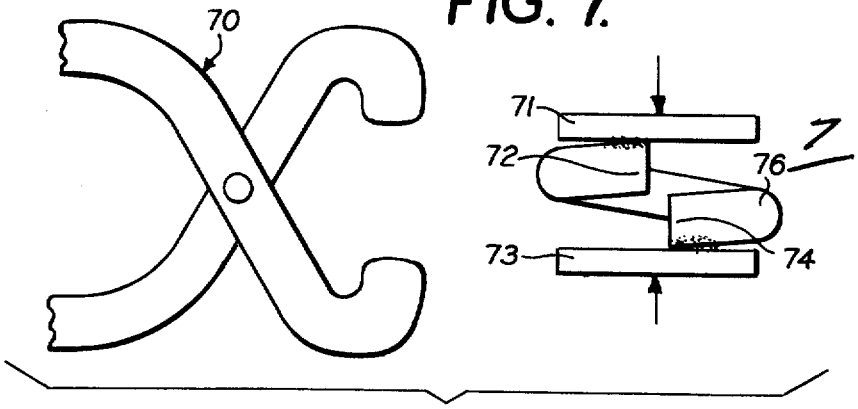

MECHANICAL MAGNETS OF MAGNETOSTRICTIVE, REMANENT, CIRCULARLY MAGNETIZED MATERIAL

RELATED APPLICATIONS

This application is related to four other applications filed by me of even date and entitled ELECTROMECHANICAL TRANSDUCERS, Ser. No. 488,219, ELECTROMAGNETIC ANISOTROPIC DEVICES, Ser. No. 488,209, MAGNETOELASTIC, REMANENT, HYSTERITIC DEVICES, Ser. No. 488,208, and METHOD AND APPARATUS FOR CIRCULARLY MAGNETIZING A HELICAL ROD, Ser. No. 488,220. The contents of all four of these applications are hereby incorporated by reference in their entireties.

BACKGROUND OF THE INVENTION

1. Field of the Invention

This invention relates to magnets and particularly to magnets that are controlled as to field strength and plurality by mechanical twisting.

2. Description of the Prior Art

For many years the so-called Wiedemann Effect has been well known. The Wiedemann Effect is a twist produced in a wire that exhibits magnetostriction when that wire is placed in a longitudinal magnetic field and current flows through the wire. The converse or inverse of this has also been long recognized and is commonly called the Inverse Wiedemann Effect. In the Inverse Wiedemann Effect axial magnetization is produced by a magnetostrictive wire that carries current therethrough when the wire is twisted.

There have been a number of attempts to employ the effect outside of the rod as the entire magnetic field produced by the anisotropic remanence is wholly within the rod and hence is not externally apparent. However, if the rod is twisted, the direction of anisotropy will be shifted from the circular to a helical direction whereby to cause the magnetic induction to align with a new direction of anisotropy and thus have a longitudinal component. This will cause longitudinally extending magnetic flux to appear at the ends of the rod and thereby exhibit magnetism.

BRIEF DESCRIPTION OF THE DRAWINGS

In the drawings

FIG. 1 is a top plan view of a mechanical magnet embodying the present invention;

FIG. 2 is a front elevational view thereof;

FIG. 3 is a bottom view of the pole pieces thereof;

FIG. 4 is a top plan view of a modified form of mechanical magnet embodying the present invention;

FIG. 5 is a view partly in vertical section and partly in elevation of the mechanical magnet of FIG. 4;

FIG. 6 is a bottom view of the pole pieces of the magnet of FIGS. 4 and 5; and

FIG. 7 is a front elevational view of yet another modification of this invention.

DETAILED DESCRIPTION OF THE PREFERRED EMBODIMENTS

Referring now to the drawings in detail and particularly to FIGS. 1–3 thereof, a mechanical magnet embodying the present invention is generally designated by the reference numeral 10. The mechanical magnet 10 includes a T shaped support member 12 wherein the horizontal portion 14 thereof, hereinafter referred to as the bearing portion, is made of a suitable ferro-magnetic material such as, for example, soft iron and the vertically extending portion 16 is made of a non-magnetic material such as, for example, an austenitic stainless steel. Provided in the bearing piece 14 are a pair of vertically extending apertures 18 and 20 through which vertically extending rods 22 and 24 pass with close clearance to permit rotation thereof relative to the cross piece 14. Fixed to the bottoms of the rods 22 and 24 are magnetic pole pieces 26 and 28 which are spaced apart by the bottom 30 of the non-magnetic vertical member 16 which provides the "air gap" between the pole pieces 26 and 28. Pole pieces 26 and 28 are firmly secured to the piece 30 as by soldering, welding or the like so that the assembly is mechanically unitary and can resist the substantial torques to which the rods 22 and 24 will be subjected as will be described hereinafter.

Slightly above the upper surface of the magnetic bearing portion 14, the rods 22 and 24 are bent at right angles and the right angle or horizontal portions thereof are secured to suitable horizontally extending handles 32 and 34, respectively. As shown herein the manner of securing is by way of a press fit of the ends of the rods 22 and 24 into complementary cavities 36 and 38 in the ends of the handles 32 and 34, respectively.

The rods 22 and 24 are made of magnetostrictive magnetically remanent, circularly anisotropic material that has been circularly magnetized as by passing a direct current through the rod. The size of that current is dependent on the nature of the material and may vary anwhere from an order of magnitude of one ampere to hundreds of amperes. Generally speaking, to avoid significant heating effects, if large currents are employed to impart circular magnetization to the rods 22 and 24, a single half cycle of an alternating current is passed through each rod to impart the circular magnetization thereto.

Suitable materials from which the rods 22 and 24 can be made are maraging steels, and an iron-colbalt alloy sold by Carpenter Steel Company under the trademark REMENDUR. Other materials that may be employed, although not as effectively as those heretofor mentioned are Martensitic chrome steels and other Martensitic steels such as stainless steels in the AISI 300 and 400 series that have been put through a martensitic transformation. However, it has been found that when many of these steels that are less desirable are employed, as the rods 22 and 24 go through successive twisting there is an attenuation of the remanent magnetism within the rod which results in a fall off of the magnetic effect produced, as will be described hereinafter.

As already noted the rods 22 and 24 are fixed at their pole pieces by the securement of the pole pieces 26 and 28 to the intervening non-magnetic member 30, but are rotatable relative to the bearing portion 14 of the T shaped support. Thus, when handles 32 and 34 are grasped out at their arcuate portions and are pressed toward one another, the vertical portions of rods 22 and 24 which, for example, may have a diameter of about ⅛ inch, will be twisted through a small angle of the order of magnitude of 2° through a length of about 2 inches or a twist of about 1° per inch. Upon twisting the rods 22 and 24, and it should be noted that the direction of twisting is opposite for each of the two rods, the circular anisotropy of the rods 22 and 24 will be shifted into a helical anisotropy. Thus, the circular remanence will become a helical remanence and therefore inherently have a longitudinal component in each of the rods 22 and 24. Since both rods 22 and 24 have been circularly magnetized in the same circular direction, when they are twisted in opposite directions, that helices of the anisotropy (and hence of the magnetic remanence) will be in opposite directions and therefore the polarity of the external fields being exhibited at the pole pieces 26 and 28 will be opposite one another, that is one being a north pole and the other being a south pole. Thus, a complete magnet from the exterior of the device is now present.

It will be obvious that the reason for the bearing piece 14 to be made of ferromagnetic material is that it serves as a magnetic bridge in the magnetic circuit which runs from one of the pole pieces 26, through the rod 22, through the horizontal bearing member 14, down through the rod 24 to the opposed pole piece 28. Thus a true horseshoe shaped magnet is observed. However, when the handles are released, the elasticity of the rods 22 and 24 will restore them to a zero twist condition whereby to restore the magnetic anisotropy in the rods to a circular anisotropy and the longitudinal field will disappear. The device will then again be apparently non-magnetic.

It should be noted that on each of the handles 32 and 34 there is a small protuberance 40 and 42 which protuberances move into engagement with one another when the handles are grasped and squeezed towards one another. These protuberances 40 and 42 serve as stops to limit the amount of twist to which the rods 22 and 24 are subjected in order to avoid exceeding the elastic limit of the rods. If the elastic limit is exceeded, then the rods will become permanently helically anisotropic and will continuously exhibit an external magnetic field. At that point it will not be possible to "shut the magnet off" by releasing the handles. However so long as the elastic limit of the rods is not exceeded, the magnet can be turned on and off merely by operating the handles to twist within the elastic limit.

It has previously been suggested in this application and it should be noted that certain other materials previously mentioned gradually lose their remanent magnetization as they go through a series of twists whereby to cause the phenomenon heretofor described to disappear after a number of operations. However, as also described maraging steels and REMENDUR do not appear to exhibit this phenomenon of attenuation of remanence and have been successfully operated in the above described fashion for many thousands of operations.

In connection with the materials from which the rods 22 and 24 are made, it should be pointed out that it is desirable for the material to be as non-hysteritic as possible and yet yield the other properties heretfor described. By hysteritic we mean a hysterisis curve that appears when axial magnetic induction is plotted against angle of twist. However, it is conceivable that for certain applications a substantial hysterisis might be desirable thereby to have a remanent exterior magnetization persist even after the handles have been released. In any event, if it is desirable to overcome any hysterisis that may be present, all that need be done is to grasp the handles and slightly force them away from one another beyond the normal position assumed by the elasticity of the rods 22 and 24, whereby to torsionally strain the rods slightly in the opposite direction and thus bring the longitudinal field to zero.

A modified form of mechanical magnet is shown in FIGS. 4, 5 and 6, wherein the pole pieces are coaxial rather than spaced apart and paralled as in the FIG. 1 embodiment. Specifically, referring now to FIGS. 2, 5 and 6, a modified form of mechanical magnet 50 is shown which mechanical magnet comprises an external hollow cylindrical member 52 and an internal longitudinally extending rod 54, both of which are made of magnetostrictive, magnetically remanent, circularly magnetically anisotropic, circularly magnetized materials which may be identical to the materials from which the rods 22 and 24 of the FIG. 1 embodiment have been made. The tube 52 has secured thereto a handle 56 and the rod 54 is fixed to a bearing plug 58 that is rotatably mounted within the top of the tube 52. The means of connecting rod 54 to plug 58 may be any suitable means such as, for example, a pressed fit, welding, soldering or the like. Plug 58 is made of a ferromagnetic material such as, for example, soft iron. Fixed to the portion of plug 58 extending above the upper edge of the tube 52 is a second handle 60, the two handles describing an approximate "C" shape much like a pair of pliers or a scissors or the like.

The tube 52 and the rod 54 are both going to be subjected to torsion by the squeezing of the handles 56 and 60 toward one another. In order for the torsion to appear, the lower ends of the rod and tube must be secured to one another against relative movement. This is achieved by means of a non-magnetic washer 62, preferably made of a non-magnetic metal such as an austenitic stainless steel, which is fixed to the internal surface of the tube 52 and to the outer surface of the rod 54 at the bottom thereof by any suitable means such as solder, welding or the like. The washer 62 will serve to define an air gap between the pole pieces which are the bottoms of the rod and tube. To limit the amount of twist, a stop 64 is secured to one of the handles for engagement with the other of the handles as they are brought toward one another. As shown the stop 64 is a pin that is fixed to the handle 56 and is engagable with a side of the handle 60.

When the handles 56 and 60 are moved toward one another as by squeezing, the twist on the rod 54 will be clockwise whereas the twist on the tube 52 will he counter-clockwise. As both the rod and the tube are preferably circularly magnetized in the same circular direction, these opposite twists will give a rise to an opposite polarity at the pole pieces, that is at the bottoms of the tube and rod. The magnetic path may be traced from the bottom of the tube 52, upwardly through the tube, through the ferromagnetic plug 58 and thence downwardly through the rod 54.

It will be obvious to those skilled in the art that the amount of twist imposed on the tube 52 and the rod 54 will be different due to the differences in geometry of these two members. This being the case, if the tube and rod are made of the same material they will contribute different amounts of axial magnetic flux to the gross magnetic phenomenon produced by the squeezing of the handles. It is generally desirable that they make equal contributions of axial flux. In order to accomplish this, it may be desirable that the materials in which they tube and rod are made are different. The differences that should be built in are generally either in the property of magnetostrictive coefficient or the amount of magnetic remanence which the material is capable of exhibiting. Thus, in one embodiment which I have constructed, both the tube 52 and the rod 54 were made up of the same martensitic chrome steel which was heated to 1000°C and then air cooled. Subsequent to air cooling the rod was annealed at 600°C and tube at 700°C thereby to make the tube 52 more susceptible to twist than the rod 54 to produce approximately the same shift in anisotropy upon the squeezing of the handles 56 and 60.

Referring now to FIG. 7 still another form of mechanical magnet is shown which mechanical magnet is in the form of a simple lock washer. However, the material from which the lock washer is made must be a material that exhibits magnetostriction, is circularly magnetically remanent, is magnetically anisotropic in the circular direction and has been circularly magnetized. As is well known, the ends of a lock washer are not coplanar but are displaced relative to one another out of the plane of the washer. Thus, in effect, a lock washer is a segment of a helical spring. This being the case, if a suitable pliers 70 is brought into engagement with the non-magnetic washers 71 and 73 overlying and underlying ends 72 and 74 of the lock washer 76 and the pliers are squeezed to bring the ends 72 and 74 into alignment with one another, the washer 76 is being twisted and this twisting will shift the anisotropy of the material from circular to helical and thereby cause some longitudinal component of magnetic flux to appear at the pole pieces 72 and 74. If desired, the pole pieces 72 and 74 can be shaped in well known ways to maximize the magnetic field in the air gap therebetween.

It will be recognized that the mechanical magnetic phenomenon heretofor described can be achieved with a single straight rod similar to the rod 22 or 24 of the FIG. 1 embodiment. Clearly, one end of the rod must be held whereas the other end is twisted. One end will become north and the other end will become south much in the way of a bar magnet. However, as is true of bar magnets, the overall magnetic effect is relatively inefficient due to the great spacing of the two poles. The embodiments heretofor described puts the poles in close proximity to one another and therefor are generally more desirable.

While I have herein shown and described the preferred form of the present invention, and have suggested modifications thereof, other changes and modifications may be made therein within the scope of the appended claims without departing from the spirit and scope of this invention.

I claim:

1. A mechanical magnet, comprising a rod of magnetostrictive, remanent, circularly magnetically anisotropic, circularly magnetized material, and means for twisting said rod, whereby to alter said circular anisotropy to helical anisotropy and thus reorient the circular magnetic field to a helical field with an axial component.

2. The mechanical magnet of claim 1, further comprising a second magnetostrictive, remanent, circularly magnetically anisotropic, circularly magnetized rod parallel to the first, both said rods being circularly magnetized in the same direction, and means for twisting said second rod in a direction opposite to the direction of twist for said first rod.

3. The mechanical magnet of claim 2, wherein said means for twisting said rods comprises non-magnetic means for fixing one end of each rod against rotation, and oppositely operable handle means secured to the other ends of said rods for imparting opposite twist thereto.

4. The mechanical magnet of claim 3, further comprising a ferromagnetic bearing member adjacent said other end of said rods having parallel apertures through which said rods extend.

5. The mechanical magnet of claim 4, further comprising means for preventing the twist of said rods beyond their elastic limit.

6. The mechanical magnet of claim 2, wherein one of said rods is tubular and the second rod is coaxial with said first rod.

7. The mechanical magnet of claim 6, wherein said means for twisting said rods comprises non-magnetic means for fixing one end of each rod against rotation, and oppositely operable handle means secured to the other ends of said rods for imparting opposite twist thereto.

8. The mechanical magnet of claim 7, further comprising a ferromagnetic plug rotatably mounted in said tubular rod and having said second rod fixedly secured thereto.

9. The mechanical magnet of claim 8, wherein said tubular rod is made of more twistable material than said second rod.

10. The mechanical magnet of claim 9, further comprising means for preventing the twist of said rods beyond their elastic limit.

11. The mechanical magnet of claim 1, wherein said rod is shaped into the form of a lock washer.

12. The mechanical magnet of claim 1, further comprising a second magnetostrictive, remanent, circularly magnetically anisotropic, circularly magnetized rod having an end in spaced relation to an end of said first rod, both said rods being circularly magnetized in the same direction, and means for twisting said second rod in a direction opposite to the direction of twist of said first rod, whereby to alter the circular anisotrop of said second rod to helical anisotrop having an axial component extending opposite to the axial component of said first rod and thus reorient the circular magnetic field of said second rod to a helical field with an axial component extending opposite to the axial component of said helical field in said twisted first rod, whereby to form said spaced ends of said two rods into magnetic pole pieces of opposite polarity.

13. The mechanical magnet of claim 1, further comprising a second magnetostrictive, remanent, circularly magnetically anisotropic, circularly magnetized rod having an end in spaced relation to an end of said first rod, both said rods being circularly magnetized, and means for twisting said second rod in a direction to alter the circular anisotrop of said second rod to helical anisotrop having an axial component extending opposite to the axial component of said first rod and thus reorient the circular magnetic field of said second rod to a helical field with an axial component extending opposite to the axial component of said helical field in said twisted first rod, whereby to form said spaced ends of said two rods into magnetic pole pieces of opposite polarity.

* * * * *

UNITED STATES PATENT AND TRADEMARK OFFICE

CERTIFICATE OF CORRECTION

PATENT NO. : 3,939,448

DATED : February 17, 1976

INVENTOR(S) : Ivan J. Garshelis

It is certified that error appears in the above-identified patent and that said Letters Patent are hereby corrected as shown below:

Column 1, line 12: "HYSTERITIC" should read --HYSTERETIC--
Column 1, line 23: "plurality" should read --polarity--
Column 2, line 34: "anwhere" should read --anywhere--
Column 3, line 56: "non-hysteritic" should read --non-hysteretic-
Column 3, line 57: "heretfor" should read --heretofore--
Column 3, line 58: "hysteritic" should read --hysteretic--
Column 3, line 58: "hysterisis" should read --hysteresis--
Column 3, line 61: "hysterisis" should read --hysteresis--
Column 3, line 65: "hysterisis" should read --hysteresis--
Column 4, line 46: "he" should read --be--
Column 4, line 64: "they" should read --the--
Column 6, line 42: "anisotrop" should read --anisotropy--
Column 6, line 43: "anisotrop" should read --anisotropy--
Column 6, line 57: "anisotrop" should read --anisotropy--
Column 6, line 58: "anisotrop" should read --anisotropy--

Signed and Sealed this

Fourteenth Day of September 1976

[SEAL]

*Attest:*

RUTH C. MASON
*Attesting Officer*

C. MARSHALL DANN
*Commissioner of Patents and Trademarks*